United States Patent [19]

Lancaster

[11] Patent Number: 4,691,497

[45] Date of Patent: Sep. 8, 1987

[54] FILM LAMINATION STRETCH WRAPPING

[75] Inventor: William G. Lancaster, Louisville, Ky.

[73] Assignee: Lantech, Inc., Louisville, Ky.

[21] Appl. No.: 845,556

[22] Filed: Mar. 28, 1986

[51] Int. Cl.[4] ..... B65B 11/04

[52] U.S. Cl. ..... 53/399; 53/449; 53/172; 53/556; 53/587; 53/441

[58] Field of Search ..... 53/441, 449, 172, 556, 53/587; 156/162, 164, 192, 495

[56] References Cited

U.S. PATENT DOCUMENTS

| | | | |
|---|---|---|---|
| 2,257,823 | 10/1941 | Stokes | 53/172 X |
| 2,260,064 | 10/1941 | Stokes | 53/172 X |
| 2,397,838 | 4/1946 | Chavannes | 156/164 |
| 2,429,177 | 10/1947 | Young | 156/164 |
| 2,564,594 | 8/1951 | Clarke | 53/172 |
| 3,329,549 | 7/1967 | Vilutis | 156/495 X |
| 3,481,808 | 12/1969 | Wilkins | 156/192 X |
| 4,387,548 | 6/1983 | Lancaster et al. . | |
| 4,387,552 | 6/1983 | Lancaster et al. . | |
| 4,418,114 | 11/1983 | Briggs | 53/441 X |
| 4,418,510 | 12/1983 | Lancaster et al. . | |

*Primary Examiner*—John Sipos

*Attorney, Agent, or Firm*—Finnegan, Henderson, Farabow, Garrett & Dunner

[57] ABSTRACT

A method and apparatus for assembling and dispensing a multi-ply web and wrapping a load with the multi-ply web includes a film web dispenser for receiving a plurality of webs from a plurality of rolls of web material, juxtaposing the plurality of webs to form a multi-ply web and dispensing the multi-ply web. The load is rotated relative to the film web dispenser to wrap the multi-ply film on the load and tension is maintained on the multi-ply web between the film web dispenser and the load. A core material such as a web of foam, UV-resistant material, or reinforcement netting is inserted between the plurality of webs prior to dispensing the multi-ply web. Rollers and a clutch and brake assembly are used to intermittently forward the web of core material.

36 Claims, 1 Drawing Figure

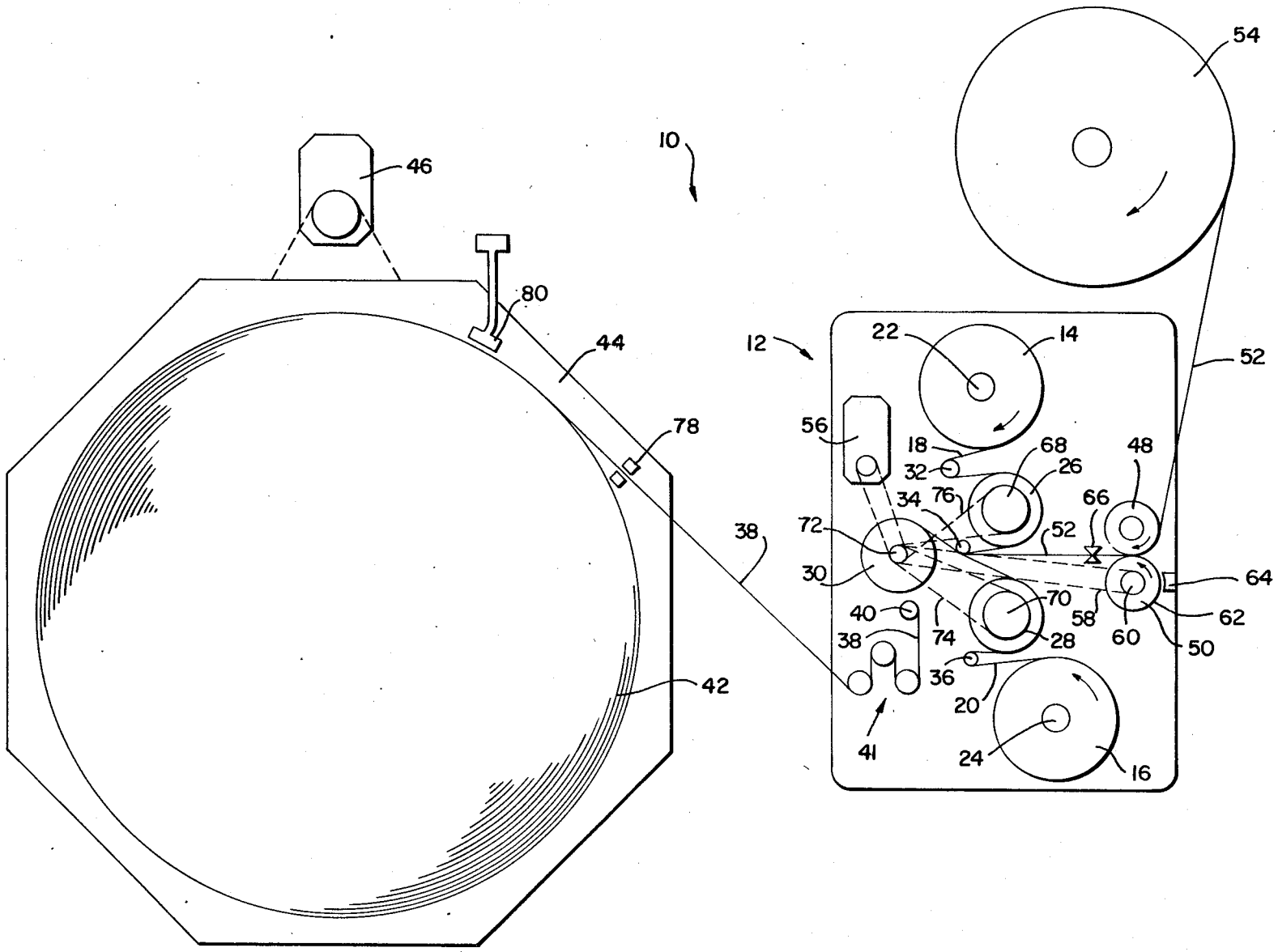
10
12
14
16
18
20
22
24
26
28
30
32
34
36
38
40
41
42
44
46
48
50
52
54
56
58
60
62
64
66
68
70
72
74
76
78
80

FILM LAMINATION STRETCH WRAPPING

BACKGROUND OF THE INVENTION

1. Field of the Invention

The present invention relates to packaging and more particularly to a method and apparatus for assembling and dispensing a multi-ply web and wrapping a load with the multi-ply web.

2. Description of the Related Art

Case packing or boxing is a common way of packaging products. Multiple unit products are generally stacked in a corrugated box or are wrapped with kraft paper with the ends of the kraft paper being glued or taped. Another way of packaging such products is by putting a sleeve or covering of heat-shrinkable film around the products and shrinking the sleeve to form a unitized package.

Stretch wrapping is a technique used to apply a web of stretchable plastic film to loads for containment of the loads. Exemplary stretch wrapping processes and apparatus are disclosed in U.S. Pat. Nos. 4,418,510; 4,387,548; and 4,387,552 to Lancaster, et al., and are incorporated in this application by reference.

Known packaging arrangements do not provide an effective and efficient method and apparatus for selectively forming and applying a protective material to the load in a packaging operation. Known arrangements also do not provide a method and apparatus capable of a variety of selected applications for assembling different multi-ply webs and wrapping them on a load in a unified operation.

Therefore, it is an object of the present invention to provide an effective and efficient method and apparatus for selectively forming and applying protective material to the load in a packaging operation.

It is also an object of the present invention to provide a method and apparatus capable of a variety of selected applications for assembling different multi-ply webs and wrapping them on a load in a unified operation.

Additional objects and advantages of the invention will be set forth in the description which follows, and in part will be obvious from the description, or may be learned by practice of the invention. The objects and the advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, there is provided an apparatus for assembling and dispensing a multi-ply web and wrapping a load with the multi-ply web. The apparatus includes film web dispenser means for receiving a plurality of webs from a plurality of rolls of web material, juxtaposing the plurality of webs to form a multi-ply web and dispensing the multi-ply web. Means are included for rotating the load relative to the film web dispenser means to wrap the multi-ply web on the load. The apparatus further includes means for maintaining tension on the multi-ply web between the film web dispenser means and the load and also includes means for inserting core material between the plurality of webs prior to dispensing the multi-ply web.

It is preferable that the film roll dispenser include upstream roller means for receiving a plurality of webs from at least two rolls of web material, downstream roller means for receiving the plurality of webs from the upstream roller means and for dispensing the film web as a multi-ply film web, and means for prestretching at least one of the webs between the upstream and downstream roller means.

It is also preferable that the insertion means includes means for forwarding a web of core material including selectively powdered rollers for intermittent forwarding of the web of core material. It is further preferable that the intermittent forwarding means includes clutch means for selectively engaging the selectively powered rollers with a power drive and brake means or selectively braking the selectively powered rollers.

BRIEF DESCRIPTION OF THE DRAWING

The accompanying drawing, which is incorporated in and constitutes a part of the specification, illustrates a preferred embodiment of the invention and, together with the general description given above and the detailed description of the preferred embodiment given below, serves to explain the principles of the invention.

The figure is a top schematic view of a film lamination stretch wrapping apparatus incorporating the teachings of the present invention.

DESCRIPTION OF THE PREFERRED EMBODIMENT

Reference will now be made in detail to the present preferred embodiment of the invention as illustrated in the accompanying drawing.

In accordance with the present invention there is provided an apparatus for assembling and dispensing a multi-ply web and wrapping a load with the multi-ply web comprising film web dispenser means for receiving a plurality of webs from a plurality of rolls of web material, juxtaposing the plurality of webs to form a multi-ply web and dispensing the multi-ply web; means for rotating the load relative to the film web dispenser means to wrap the multi-ply film on the load; means for maintaining tension on the multi-ply web between the film web dispenser means and the load; and means for inserting a core material between the plurality of webs prior to dispensing the multi-ply web.

As here embodied and depicted in the drawing there is an apparatus 10 for assembling and dispensing a multi-ply web and wrapping a load with a multi-ply web. Film web dispenser means such as film web dispenser 12 supports a plurality of rolls 14 and 16 web material 18 and 20 such as stretchable plastic film. Rolls 14 and 16 can be mounted to rotate about spindles 22 and 24 within the film web dispenser as shown in the drawing, or can be positioned and supported external to the film web dispenser 12. Film web dispenser 12 also juxtaposes a plurality of webs 18 and 20 through the use of upstream roller means such as upstream rollers 26 and 28 and downstream roller means such as downstream roller 30.

One of the plurality of webs 18 passes around idler roller 32, upstream roller 26, idler roller 34, and downstream roller 30. The second of the plurality of film webs 20 passes around idler roller 36, second upstream roller 28, idler roller 34, and downstream roller 30 where it is juxtaposed with the first of the plurality of webs 18 and forms a multi-ply web 38. Idler roller 34 may be eliminated if the rollers 30, 26, 28, 48 and 50 are appropriately arranged. The multi-ply web 38 proceeds from downstream roller 30, around idler roller 40 and around a series of rollers 41 connected to a load cell which senses the tension on the multi-ply web. From the load cell and rollers 41, the multi-ply web 38 is dispensed from film web dispenser 12 onto a load 42 to be wrapped.

Load 42 can comprise any load which needs wrapping, such as a roll of carpet, a roll of paper, a group of stacked units, or the like.

As shown in the drawing, load 42 has a cylindrical cross-section and comprises a pallet load which is supported by platform 44. A means, shown in FIG. 1 as chain and motor drive 46, is used to rotate platform 44 and thus load 42 relative to the film web dispenser 12 to wrap the multi-ply film 38 on the load 42. In such an arrangement, the film web dispenser is stationary and the load 42 rotates. The means for rotating the load relative to the film web dispenser may alternatively comprise an arrangement in which the load is stationary and the fil web dispenser is revolved around the load in the manner shown in U.S. Pat. No. 4,524,568 to Lancaster et al., which is incorporated in this application by reference.

According to the present invention there is provided means for maintaining tension on the multi-ply web between the film web dispenser and the load. As shown in the drawing, load cell and rollers 41 sense the tension on the multi-ply web and control the operation of motor 56. Motor 56 drives downstream roller 30, and by responding to the sensed tension in the web, maintains the desired tension on the multi-ply web between the film web dispenser and the load.

A pair of rollers 48 and 50, interconnected by meshed pinions, form means for inserting a core material 52, between the plurality of webs 18 and 20 prior to dispensing the multi-ply web 38 from film web dispenser 12 onto load 42. The embodiment of the core material 52 shown in the drawing is a web stored on a roll 54 which rotates to unwind during use.

As shown in the drawing, motor 56 drives downstream roller 30 and upstream rollers 26 and 28 by a chain and sprocket connection. In addition, motor 56 drives chain 58 which engages sprocket 60. Sprocket 60, in turn, is selectively engaged with roller 50 by means of a clutch 62 which can selectively engage a frictional surface on the far side of a sprocket 60 with a frictional surface on the near side of upstream roller 50. In such a fashion, the web of core material 52 can be selectively forwarded.

In addition, a brake such as brake shoe 64 can be selectively engaged with roller 50 to selectively brake the rollers 48 and 50. In such a fashion, the brake 64 can effectively sever the advancing web of core material at a point between rollers 48 and 50, and downstream roller 30 so that portions of core material 52 can be positioned at chosen locations on load 42 during wrapping. Alternatively, core material 52 can be selectively severed by cutters such as opposing blades 66.

Film web dispenser 12 preferably includes means for prestretching at least one of the webs between the upstream and downstream rollers. As shown in the drawing, such prestretching means includes large sprockets 68 and 70 on upstream rollers 26 and 28, respectively, and small sprocket 72 on downstream roller 30. The prestretching means also includes chains 74 and 76 which connect sprockets 68, 70 and 72. This apparatus causes the web engaging surface of the downstream roller 30 to be driven at a faster speed than the web engaging surface of upstream rollers 26 and 28, thereby prestretching film web 18 between upstream roller 26 and downstream roller 30 and prestretching film web 20 between upstream roller 28 and downstream roller 30. Prestretching of a film web in a film web dispenser prior to dispensing the film web on a load, in and of itself, is known, and discussed in the patents to Lancaster et al. which are cited above.

As shown in the drawing, it is preferable that the first and second upstream rollers 26 and 28 are spaced from each other and rollers 48 and 50, forming the insertion means, are positioned to insert the core material 52 downstream of first and second upstream rollers 26 and 28, namely, at idler roller 34 which juxtaposes the plurality of webs 18 and 20 on downstream roller 30.

In accordance with the present invention there is provided a method for assembling a multi-ply web 38 and dispensing and wrapping a load 42 with the multi-ply web 38 comprising receiving a plurality of webs 18 and 20 from a plurality of rolls of web material 14 and 16; inserting a core material 52, such as a web of foam, between the plurality of webs 18 and 20; juxtaposing the plurality of webs 18 and 20 to form a multi-ply web 38; dispensing the multi-ply web 38 from the film web dispenser 12; rotating the load 42 relative to the film web dispenser 12 to wrap the multi-ply web 38 on the load 42; and maintaining tension on the multi-ply web 38 between film web dispenser 12 and the load 42 while wrapping the multi-ply web 38 on the load 42 through the use of load cells and rollers 41 which control the advance of downstream roller 30 by controlling motor 56. In accordance with the present invention, it is preferable to maintain the elongation of the web between the film web dispenser 12 and the load 42 at about the same elongation as the elongation on the web during prestretching between upstream rollers 26 and 28 and downstream roller 30. This prevents the film from puckering as it is applied to the load.

Also, it is preferable to prestretch each of the plurality of webs 18 and 20 to about the same elongation to prevent puckering. In addition, it is preferable to prestretch a plurality of webs 18 and 20 having the same stress-strain characteristic to prevent puckering.

In accordance with the present invention, it is preferable to laminate the multi-ply web 38 during the prestretching between upstream rollers 26 and 28 and downstream roller 30 by contacting the plies during prestretching to cause the webs to bond to each other and form a unified laminated web.

If the load 42 is fragile or pressure sensitive, the method of the present invention preferably includes using a cushion material such as a foam web as the core material 52 during the step of inserting the core material 52 between the plurality of webs 18 and 20.

If the load 42 is sensitive to ultraviolet radiation, the method of the present invention preferably includes using a UV-resistant material as the core material 52 during the step of inserting the core material 52 between the plurality of webs 18 and 20.

If webs 18 and 20 need reinforcement in order to properly contain load 42, the method of the present invention preferably including using a reinforcement web netting as the core material 52 during the step of inserting the core material 52 between a plurality of webs 18 and 20.

It is within the scope of the present invention to use other webs of core material or a plurality of webs of core material depending on the function which is needed to be served by the multi-ply web in containing and protecting a load 42 with specific containment and protection requirements. In addition, it is within the scope of the present invention to increase the number of the plurality of webs surrounding the core material to more than two webs if such packaging demands arise.

Multiple sources of core material may be forwarded between the plurality of webs 18 and 20 for various purposes which can be selectively controlled by the operator of the apparatus. For instance, a foam roll 54 can be used to protect a pressure sensitive load 42, and in addition, a second roll of labeling material can be fed at a selected time in a fashion similar to that used to feed the web from roll 54.

Therefore, the claimed method and apparatus can be used in the same manner for a variety of different load protection and containment problems with at most a minimum amount of alteration. In addition, the ability to intermittently advance and sever a roll of core material adds a great variety of flexibility in the operations which can be accomplished.

Known stretch wrapping apparatus such as those disclsoed in the Lancaster et al. patents cited above, include clamps for clamping the leading edge of the film web to hold a web to the load while wrapping. In the drawing, such a clamp is shown as clamp 78 and is attached to support platform 44 to rotate with support platform 44 and load 42. Such a clamp can include a pair of grippers to selectively grip the film. In addition to having clamps, known film dispensers have wipe-down brushes, such as brush 80 shown in the drawing, to wipe down the trailing edge of the film so that it adheres to the load after a load has been wrapped. Such clamping devices 78 and wipe-down devices 80 often have the draw back of being sensitive to the material which is being clamped or wiped down.

According to the present invention, the leading edge of the plurality of webs can be clamped with claim 78 to hold the plurality of webs to the load 42 while wrapping and selectively inserting the core material 52 at positions spaced behind the leading edge. In such a manner, the leading edge portion of the multi-ply web 38 preferably includes the plurality of webs 18 and 20 without the core material 52 so that only the plurality of webs 18 and 20 and not the core material 52 are clamped during the clamping step.

Similarly, according to the present invention, the trailing edge of the plurality of webs 18 and 20 is wiped down against the load 42 to hold the trailing edge in place against the load. By selectively inserting the core material 52 at positions spaced ahead of the trailing edge, only a portion of the multi-ply web 38 including the plurality of webs 18 and 20 and not the core material 52 is wiped down.

It is also possible to use the method and apparatus for assembling and dispensing a multi-ply web and wrapping a load with a multi-ply web without the insertion of a core material 52 between the plurality of webs 18 and 20.

Additional advantages and modifications will readily occur to those skilled in the art. The invention in its broader aspects is, therefore, not limited to the specific details, representative apparatus and illustrative examples shown and described. Accordingly, departures may be made from such details without departing from the spirit and scope of the general inventive concept as defined by the appended claims and their equivalents.

What is claimed is:

1. An apparatus for assembling and dispensing a multi-ply web and wrapping a load with the multi-ply web comprising:

a film web dispenser including first and second upstream roller means which are spaced from each other, each for receiving at least one of a plurality of webs provided by at least two rolls of web material, downstream roller means for receiving the plurality of webs from the upstream roller means and for dispensing the film web as a multi-ply film web, and means for prestretching at least one of the webs between the upstream and downstream roller means;

means for rotating the load relative to the film web dispenser to wrap the multi-ply web on the load;

means for maintaining tension on the multi-ply web between the dispenser and the load; and means for inserting a core material between the plurality of webs upstream of the downstream roller means and downstream of the first and second upstream roller means.

2. The apparatus of claim 1 wherein the insertion means includes means for forwarding a web of core material.

3. The apparatus of claim 2 wherein the forwarding means includes selectively powered rollers for intermittent forwarding of the web of core material.

4. The apparatus of claim 3 wherein the forwarding means includes clutch means for selectively engaging the selectively powered rollers with a power drive for intermittent forwarding of the web of core material.

5. The apparatus of claim 3 wherein the intermittent forwarding means includes brake means for selectively braking the selectively powered rollers.

6. The apparatus of claim 3 including means for selectively severing the web of core material.

7. The apparatus of claim 1 including means for juxtaposing the plurality of webs on the downstream roller means.

8. A method for assembling and dispensing a multi-ply web and wrapping a load with the multi-ply web comprising:

receiving a plurality of webs from a plurality of rolls of web material;

forming a leading edge portion comprised of the plurality of webs without a core material therebetween;

inserting a core material between the plurality of webs at positions spaced behind the leading edge portion;

juxtaposing the plurality of webs to form a multi-ply web;

dispensing the multi-ply web from a film web dispenser;

clamping the leading edge portion to hold the plurality of webs to the load while wrapping;

rotating the load relative to the film web dispenser to wrap the multi-ply web on the load; and maintaining tension on the multi-ply web between the film web dispesner and the load while wrapping the multi-ply web on the load.

9. The method of claim 8 including prestretching at least one of the webs prior to dispensing the multi-ply web.

10. The method of claim 9 including maintaining about the same elongation on the web between the film web dispenser and the load as the elongation on the web during the prestretching.

11. The method of claim 9 including laminating the multi-ply web during the prestretching.

12. The method of claim 8 including inserting a cushion material during the inserting step.

13. The method of claim 8 including inserting a UV resistant material during the inserting step.

14. The method of claim 8 wherein the juxtaposing step is performed prior to the dispensing step.

15. The method of claim 8 including inserting a reinforcement web netting during the inserting step.

16. The method of claim 8 including intermittently inserting core material from a roll of web material.

17. The method of claim 16 including selectively advancing the web of core material with selectively powered rollers.

18. The method of claim 17 including severing the core material by selectively braking the selectively powered rollers.

19. The method of claim 17 including severing the core material with a cutter.

20. The method of claim 9 including prestretching each of the plurality of webs to about the same elongation.

21. The method of claim 20, including prestretching a plurality of webs of the same stress-strain characteristic.

22. The method of claim 8 including wiping down the trailing edge portion of the plurality of webs against the load to hold the trailing edge portion in place against the load and selectively inserting the core material at positions spaced ahead of the trailing edge portion so that the trailing edge portion of the multi-ply web includes the plurality of webs without the core material and so that a portion of the multi-ply web including the plurality of webs and not the core material is wiped down.

23. A method for assembling and dispensing a multi-ply web and wrapping a load with the multi-ply web comprising:

receiving a plurality of webs from a plurality of rolls of web material;

inserting a core material between the plurality of webs;

juxtaposing the plurality of webs to form a multi-ply web;

dispensing the multi-ply web from a film web dispenser;

holding the plurality of webs to the load;

rotating the load relative to the film web dispenser to wrap the multi-ply web on the load;

maintaining tesnion on the multi-ply web between the film web dispenser and the load while the wrapping the multi-ply web on the load;

forming and dispensing a trailing edge portion comprised of the plurality of webs without the core material therebetween by terminating the steps of inserting the core material between the plurality of webs;

wiping down the trailing edge portion against the load to hold the trailing edge portion in place against the load.

24. The method of claim 23 including prestretching at least one of the webs prior to dispensing the multi-ply web.

25. The method of claim 24 including maintaining about the same elongation on the web between the film web dispenser and the load as the elongation on the web during the prestretching.

26. The method of claim 24 including laminating the multi-ply web during the prestretching.

27. The method of claim 23 including inserting a cushion material during the inserting step.

28. The method of claim 23 including inserting a UV resistant material during the inserting step.

29. The method of claim 23 wherein the juxtaposing step is performed prior to the dispensing step.

30. The method of claim 23 including inserting a reinforcement web netting during the inserting step.

31. The method of claim 23 including intermittently inserting core material from a roll of web material.

32. The method of claim 31 including selectively advancing the web of core material with selectively powered rollers.

33. The method of claim 32 including severing the core material by selectively braking the selectively powered rollers.

34. The method of claim 32 including severing the core material with a cutter.

35. The method of claim 24 including prestretching each of the plurality of webs to about the same elongation.

36. The method of claim 24, including prestretching a plurality of webs of the same stress-strain characteristic.

* * * * *

UNITED STATES PATENT AND TRADEMARK OFFICE

CERTIFICATE OF CORRECTION

PATENT NO. : 4,691,497

DATED : September 8, 1987

INVENTOR(S) : William G. Lancaster

It is certified that error appears in the above-identified patent and that said Letters Patent is hereby corrected as shown below:

Claim 23: Column 8; Line 4; delete "tesnion" and substitute --tension--.

Signed and Sealed this

Fifth Day of January, 1988

*Attest:*

DONALD J. QUIGG

*Attesting Officer*

*Commissioner of Patents and Trademarks*